US007625298B2

(12) United States Patent
Bennett

(10) Patent No.: US 7,625,298 B2
(45) Date of Patent: Dec. 1, 2009

(54) DYNAMIC GOLF CLUB HEADS WITH MOMENTUM

(76) Inventor: John Emmanuel Bennett, 1570 Homewood Dr., Altadena, CA (US) 91001

( * ) Notice: Subject to any disclaimer, the term of this patent is extended or adjusted under 35 U.S.C. 154(b) by 0 days.

(21) Appl. No.: 11/891,906

(22) Filed: Aug. 14, 2007

(65) Prior Publication Data

US 2009/0098947 A1 Apr. 16, 2009

(51) Int. Cl.
*A63B 53/04* (2006.01)
*A63B 53/06* (2006.01)

(52) U.S. Cl. ..... 473/334; 473/341; 473/349

(58) Field of Classification Search ..... 473/324–350, 473/305–315

See application file for complete search history.

(56) References Cited

U.S. PATENT DOCUMENTS

| | | | | | |
|---|---|---|---|---|---|
| 709,114 | A | * | 9/1902 | Rockwell | 248/118.5 |
| 1,222,770 | A | * | 4/1917 | Kaye | 473/256 |
| 1,705,997 | A | * | 3/1929 | Quynn | 473/329 |
| 2,255,332 | A | * | 9/1941 | Russell | 473/328 |
| 2,708,579 | A | * | 5/1955 | Hugman | 473/246 |
| 3,064,975 | A | * | 11/1962 | Smith | 473/328 |
| 3,343,839 | A | * | 9/1967 | Borah | 473/249 |
| 3,680,868 | A | * | 8/1972 | Jacob | 473/328 |
| 3,806,129 | A | * | 4/1974 | Burrows | 473/249 |
| 3,817,522 | A | * | 6/1974 | Simmons | 473/332 |
| 3,841,640 | A | * | 10/1974 | Gaulocher | 473/249 |
| 3,884,477 | A | * | 5/1975 | Bianco | 473/249 |
| D235,668 | S | * | 7/1975 | Swash | D21/739 |
| 4,174,110 | A | * | 11/1979 | Yamamoto | 473/341 |
| 4,340,229 | A | * | 7/1982 | Stuff, Jr. | 473/240 |
| 4,498,673 | A | * | 2/1985 | Swanson | 473/328 |
| 4,688,798 | A | * | 8/1987 | Pelz | 473/249 |
| 4,714,252 | A | * | 12/1987 | Roraback | 473/338 |
| 4,754,976 | A | * | 7/1988 | Pelz | 473/340 |
| 4,809,977 | A | * | 3/1989 | Doran et al. | 473/249 |
| 4,915,386 | A | * | 4/1990 | Antonious | 473/350 |
| 5,046,740 | A | * | 9/1991 | D'Eath | 473/255 |
| 5,121,922 | A | * | 6/1992 | Harsh, Sr. | 473/251 |
| 5,197,737 | A | * | 3/1993 | Desbiolles et al. | 473/341 |
| 5,242,167 | A | * | 9/1993 | Antonious | 473/350 |
| 5,286,027 | A | * | 2/1994 | Koumarianos | 473/328 |
| 5,346,219 | A | * | 9/1994 | Pehoski et al. | 473/325 |
| 5,409,228 | A | * | 4/1995 | Botsch | 473/249 |
| D361,812 | S | * | 8/1995 | Rey | D21/746 |
| 5,533,728 | A | * | 7/1996 | Pehoski et al. | 473/252 |
| 5,630,765 | A | * | 5/1997 | Moore | 473/252 |

(Continued)

FOREIGN PATENT DOCUMENTS

| | | | | |
|---|---|---|---|---|
| GB | 2399297 | A | * | 9/2004 |

*Primary Examiner*—Alvin A Hunter

(57) ABSTRACT

This invention, in contrast to other golf club head inventions, presents an entirely new concept in the formulation of golf club heads. Wherein this invention utilizes the scientific properties of the spherical weight, resulting in substantial improvements in the functioning of the golf club heads and the corresponding improvements in the golf swing. A spherical weight is disposed in golf club heads, as specified, employing the scientific properties of the sphere, to develop an "in line momentum". This results in a responsive control and an easier executed golf swing. The conventional golf club, actually, is made like a small paddle with an upright handle at one end. Whereas, the golf club, of this invention, because of its specifications, embodies the weight of the club head, the spherical weight, and the club shaft, substantially, all in one line, producing a superior functioning golf club.

2 Claims, 8 Drawing Sheets

U.S. PATENT DOCUMENTS 5,643,109 A * 7/1997 Rose et al. ..... 473/329
5,658,209 A * 8/1997 Blakemore ..... 473/350
5,685,784 A * 11/1997 Butler ..... 473/340
5,820,481 A * 10/1998 Raudman ..... 473/313
5,830,078 A * 11/1998 McMahan ..... 473/252
6,267,689 B1 * 7/2001 Ambrose ..... 473/251
6,319,146 B1 * 11/2001 Mills ..... 473/244
6,350,208 B1 * 2/2002 Ford ..... 473/249
6,431,992 B1 * 8/2002 Moody ..... 473/230
6,435,975 B2 * 8/2002 Middleton ..... 473/231
6,547,672 B1 * 4/2003 Chough ..... 473/230
6,796,911 B2 * 9/2004 Grace ..... 473/251
6,896,625 B2 * 5/2005 Grace ..... 473/251
6,929,559 B1 * 8/2005 Grace ..... 473/251
6,929,564 B2 * 8/2005 Olsavsky et al. ..... 473/340
6,966,845 B2 * 11/2005 Solheim et al. ..... 473/251
6,974,394 B1 * 12/2005 Tang et al. ..... 473/335
6,988,956 B2 * 1/2006 Cover et al. ..... 473/244
6,988,959 B2 * 1/2006 Pollman ..... 473/313
7,048,639 B2 * 5/2006 Grace ..... 473/251
7,048,646 B2 * 5/2006 Yamanaka et al. ..... 473/332
7,052,411 B2 * 5/2006 Solheim et al. ..... 473/251
7,070,514 B1 * 7/2006 Borunda ..... 473/333
7,077,758 B2 * 7/2006 Rohrer ..... 473/251
7,086,957 B2 * 8/2006 Solheim et al. ..... 473/251
7,086,959 B2 * 8/2006 D'Agguano ..... 473/282
7,147,569 B2 * 12/2006 Tang et al. ..... 473/249
7,156,752 B1 * 1/2007 Bennett ..... 473/334
7,160,203 B2 * 1/2007 Bonneau ..... 473/334
7,163,463 B2 * 1/2007 Mills ..... 473/244
7,186,185 B2 * 3/2007 Nagy ..... 473/238
7,244,189 B1 * 7/2007 Stobbe ..... 473/313
7,244,191 B2 * 7/2007 Tang et al. ..... 473/335
7,255,650 B2 * 8/2007 Braynt et al. ..... 473/252
7,374,497 B2 * 5/2008 Brown ..... 473/251
2002/0034986 A1 * 3/2002 Helmstetter et al. ..... 473/340
2002/0123393 A1 * 9/2002 Tang et al. ..... 473/340
2003/0228925 A1 * 12/2003 Rohrer ..... 473/251
2004/0110573 A1 * 6/2004 Krallman ..... 473/333
2004/0132542 A1 * 7/2004 Olsavsky et al. ..... 473/336
2004/0166953 A1 * 8/2004 Grace ..... 473/251
2005/0101405 A1 * 5/2005 Lenhof et al. ..... 473/340
2005/0137027 A1 * 6/2005 Thomas ..... 473/340
2005/0159240 A1 * 7/2005 Solheim et al. ..... 473/340
2005/0159241 A1 * 7/2005 Hou ..... 473/340
2005/0159242 A1 * 7/2005 Solheim et al. ..... 473/340
2005/0227777 A1 * 10/2005 Cover et al. ..... 473/251
2005/0227779 A1 * 10/2005 Lenhof et al. ..... 473/305
2005/0239574 A1 * 10/2005 Rohrer ..... 473/340
2005/0245323 A1 * 11/2005 Byrne et al. ..... 473/242
2005/0282657 A1 * 12/2005 Solheim et al. ..... 473/340
2006/0014590 A1 * 1/2006 Tao ..... 473/249
2006/0052178 A1 * 3/2006 Franklin et al. ..... 473/340
2006/0068934 A1 * 3/2006 Tang et al. ..... 473/335
2006/0068935 A1 * 3/2006 Tang et al. ..... 473/340
2006/0094522 A1 * 5/2006 Tang et al. ..... 473/251
2006/0116216 A1 * 6/2006 Sorenson ..... 473/313
2006/0166755 A1 * 7/2006 Brown ..... 473/251
2006/0189408 A1 * 8/2006 Grace ..... 473/340
2007/0026963 A1 * 2/2007 Braynt et al. ..... 473/340
2007/0178988 A1 * 8/2007 Tavares et al. ..... 473/334

* cited by examiner

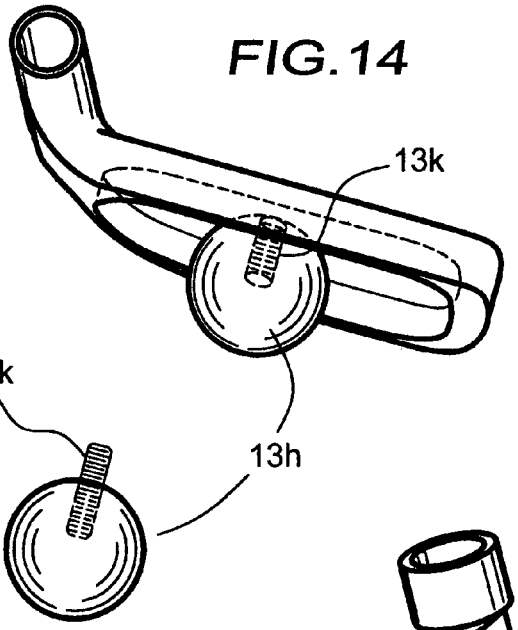
FIG.14
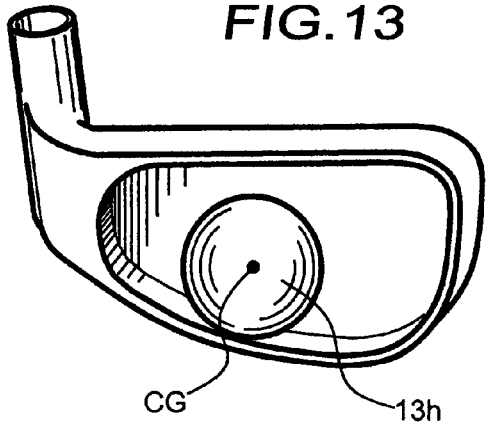
FIG.13
FIG.13b
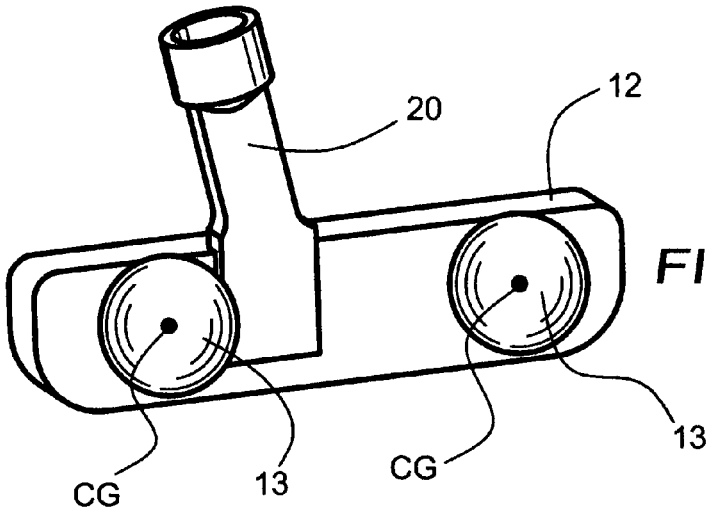
FIG.12
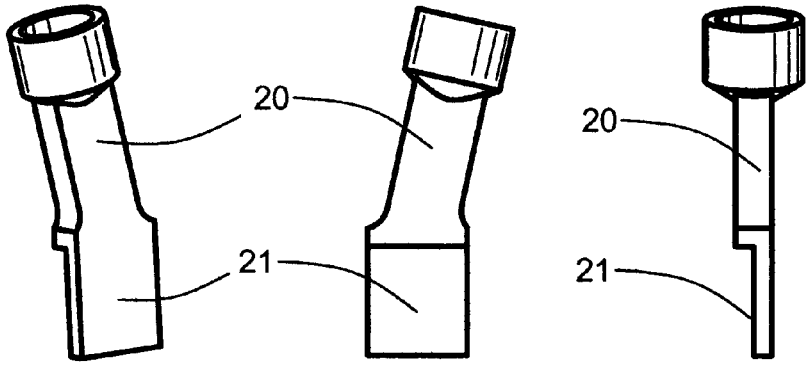
FIG.15 FIG.15a FIG.15b FIG.16a
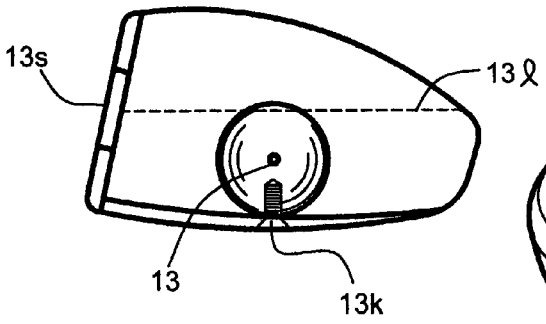
FIG.16
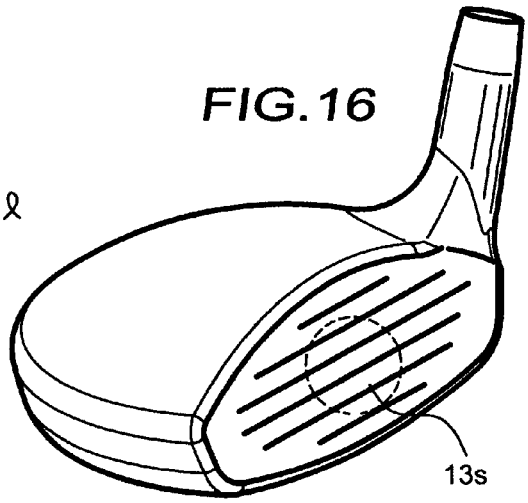
FIG.16b
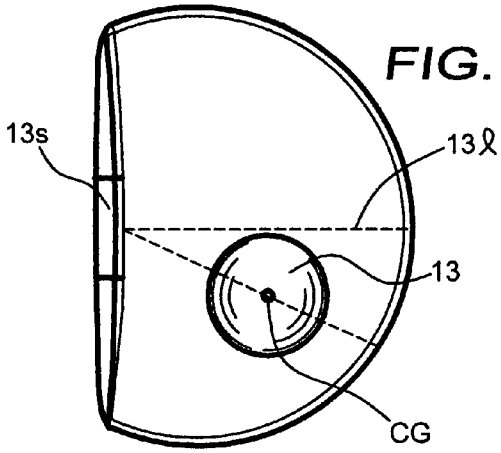
FIG.16c
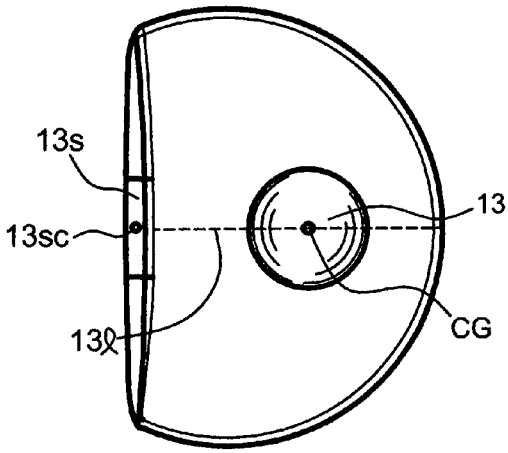
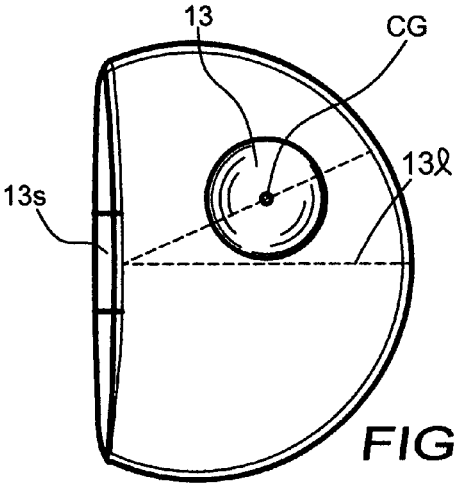
FIG.16d
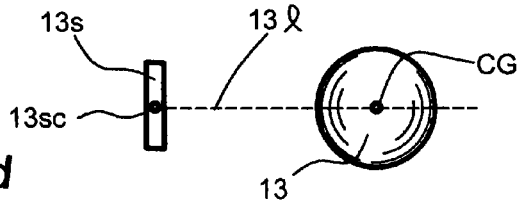
FIG.17

DYNAMIC GOLF CLUB HEADS WITH MOMENTUM

BACKGROUND OF THE INVENTION

The game of golf is in a class by itself compared to other sports. The requirement of the player, is very demanding and in every respect. It is challenging and sometimes rewarding. It is an anomaly to find a person who can successfully play golf without extensive training. The game is vexing and frustrating, wherein, great deal of effort is required even for slight progress.

The body must be able to coordinate a great number of movements in proper order and timing, to be able to strike an inch and a half ball at its center with a long implement, and hope the ball finds it way to the hole. But it is a challenge and fun. It is a difficult game to master and the invention presented herein, will improve the implements and encourage the player. But it will still require skill and effort to excell.

BRIEF SUMMARY OF THE INVENTION

This invention provides a golf club so that the player can improve his skills and enjoy the game more. The club head is so constructed, that the club head tries to maintain itself in one line during the swing of the golf club, enabling the swing to be more responsive to control. This invention utilizes the scientific properties of a sphere, wherein, a solid metalic weight is positioned to specifications, in the club head.

Said spherical weight, with its solid mass, creates an "in line momentum" and force, which precisely, affects and determines the in line swing of the club head, dramatically improving the golf swing and the resulting accuracy, with ease. And further, it creates a realistic feel of the club head. All this improves the performance and accuracy of the swing and the enjoyment of the game of golf.

DESCRIPTION OF THE DRAWINGS

All figures herein, include a spherical weight, a hosel and putter type club heads comprise a weight at each end of the blade. All figures are of golf club heads, except where noted otherwise. Items containing the number 13, refer to a spherical weight with their center of gravity noted by a dark dot and letters CG. The blade is item 12, and the hosel is item 20.

FIGURE NUMBERS

Figure 1:
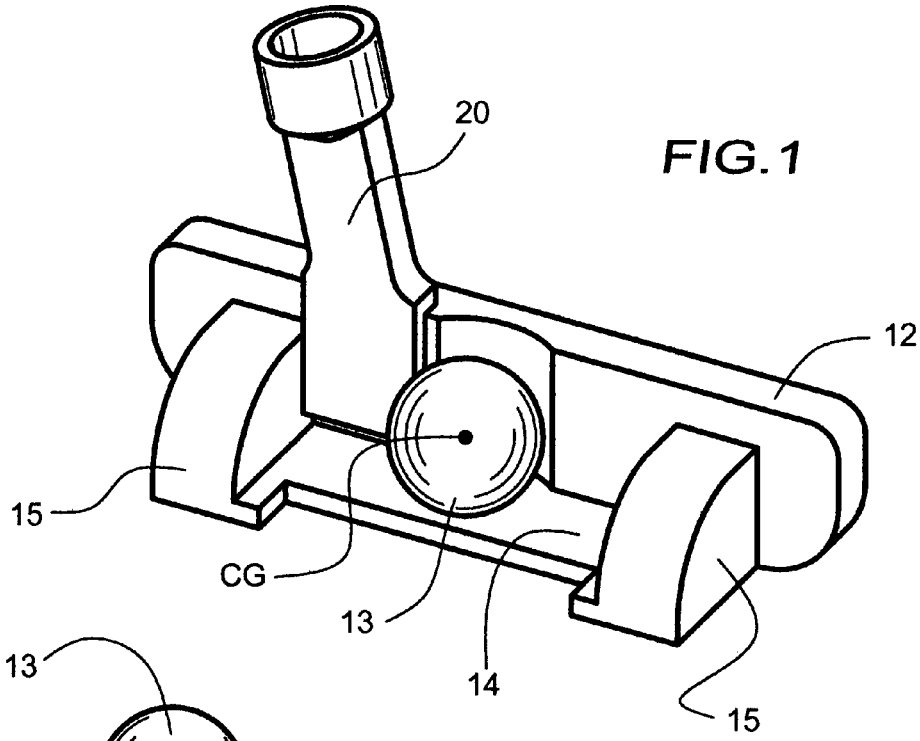

FIG. 1, is a putter wherein the end weights reach the top of the blade, with the sphere attached to the back surface of the blade.

Figure 1A:
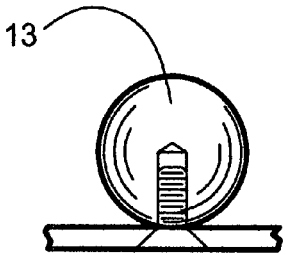

FIG. 1*a*, is a schematic drawing mounting the sphere horizontally onto the back of the blade, or vertically to a bottom plate.

Figure 2:
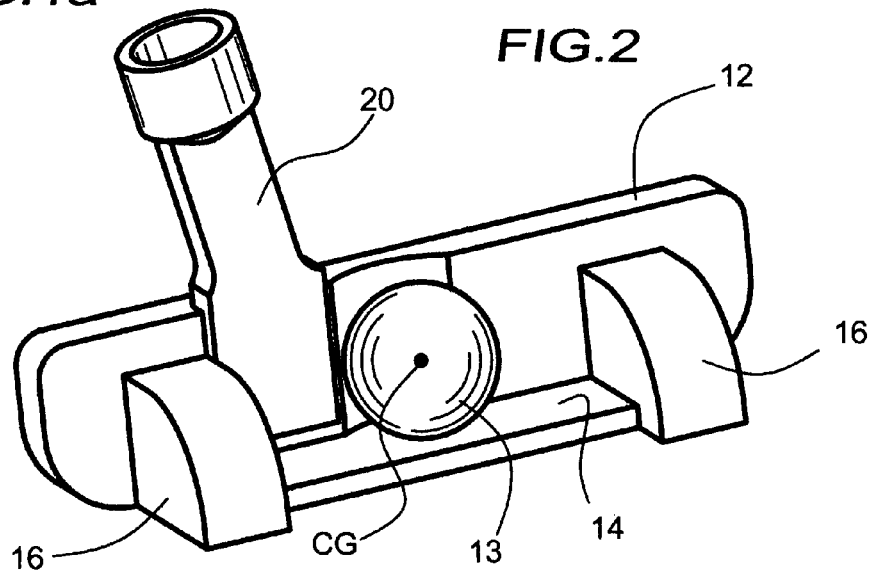

FIG. 2, is a putter wherein the end weights are lower than the top of the blade, and wherein the sphere is attached to a bottom plate.

Figure 3:
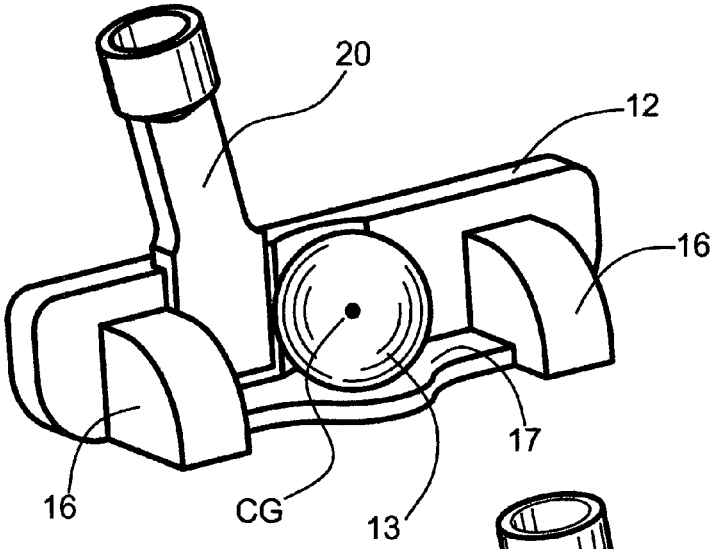

FIG. 3, is a putter wherein the spherical weight is mounted on a plate extending rearward.

Figure 4:
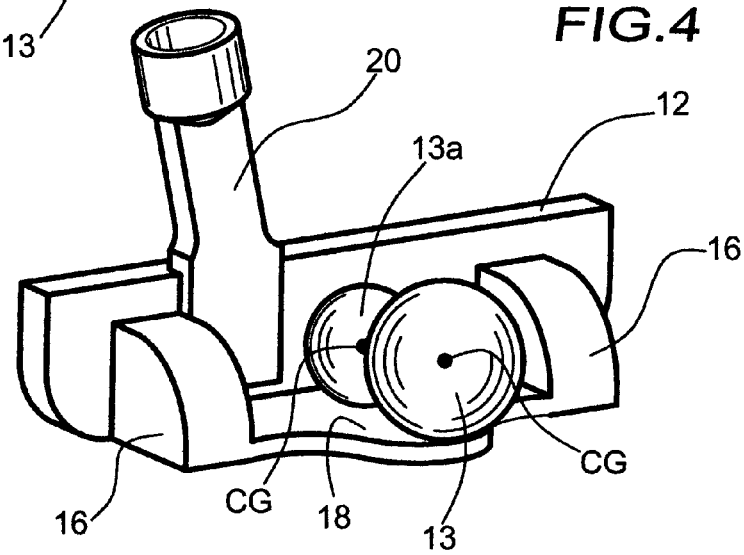

FIG. 4, is a putter with a further extended bottom plate on which plate two spherical weights are positioned.

Figure 5:
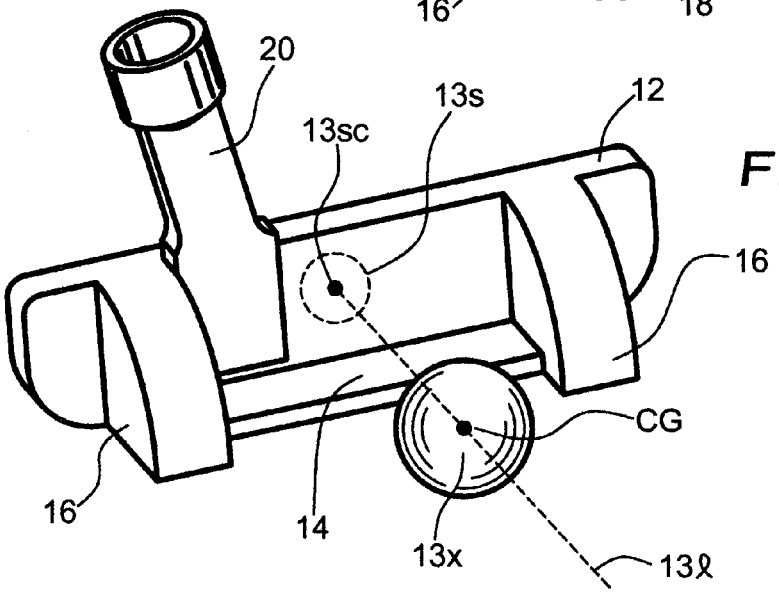

FIG. 5, is a putter with schematic diagram illustrating the "central line", I, extending rearward, from the center of the "sweet spot", through the center of the sphere, which is the manner all spherical weights are positioned.

Figure 6:
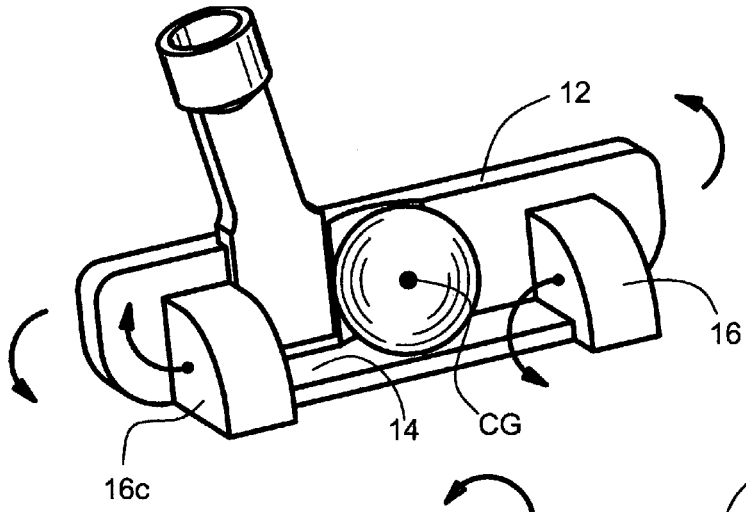

FIG. 6, is a putter with circular arrows showing the blade twisting at the start of a motion and the arrows which respond the opposite direction to remedy the torque.

Figure 6A:
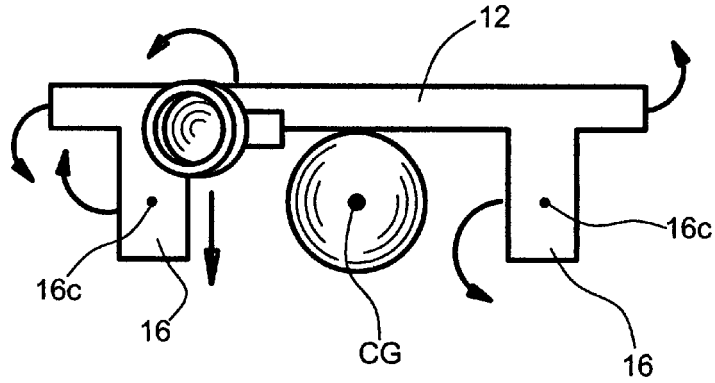

FIG. 6*a*, is a top view of FIG. 6, wherein the straight arrow indicates the starting direction of club head motion and wherein the arrows on the blade and the weights indicate the responding torques.

FIGURE

Figure 6B:
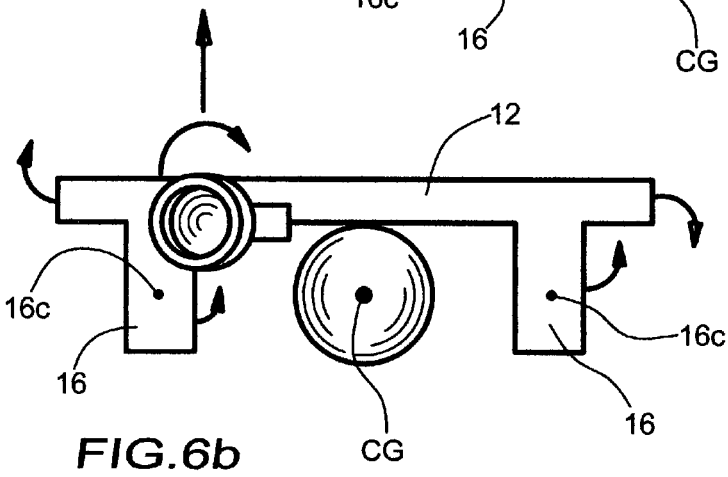

FIG. 6*b*, is like 6*a* except that the starting direction is opposite to that of 6*a*.

Figure 7:
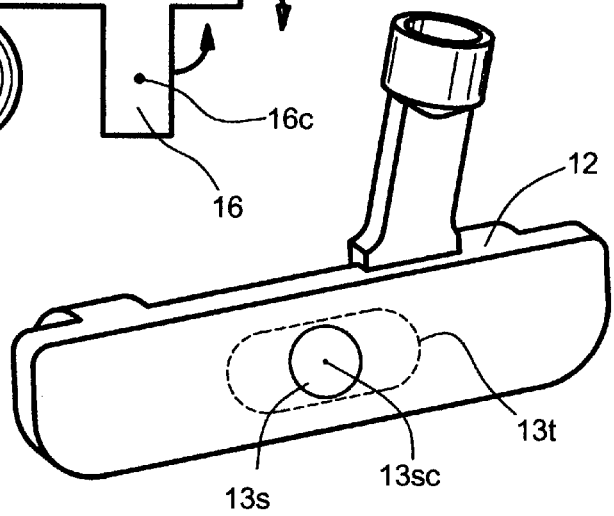

FIG. 7, is a front view of the putter, wherein, 13*t* indicates the striking area of the blade, and 13*sc*, indicates the center of the sweet spot.

Figure 8:
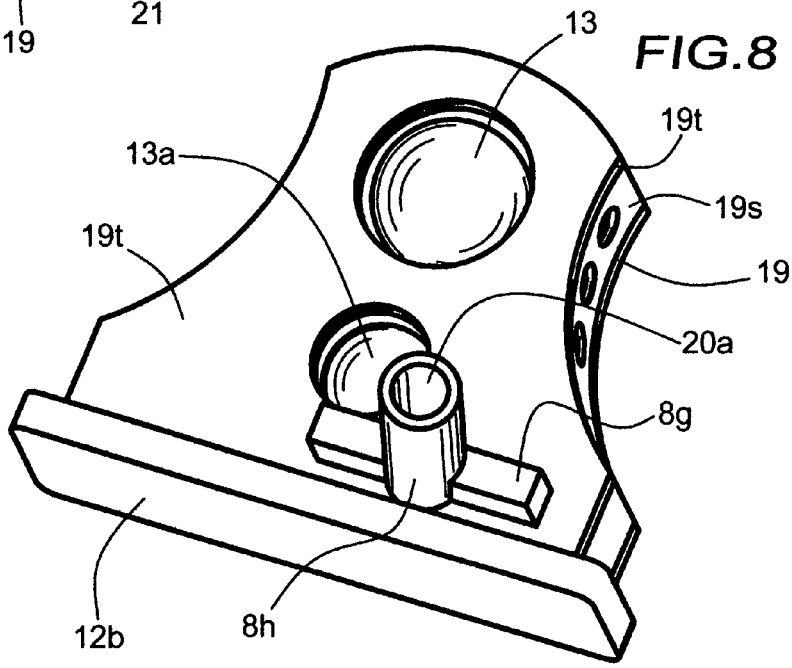

FIG. 8, is a top view of the closed mallet or shell type putter.

Figure 9:
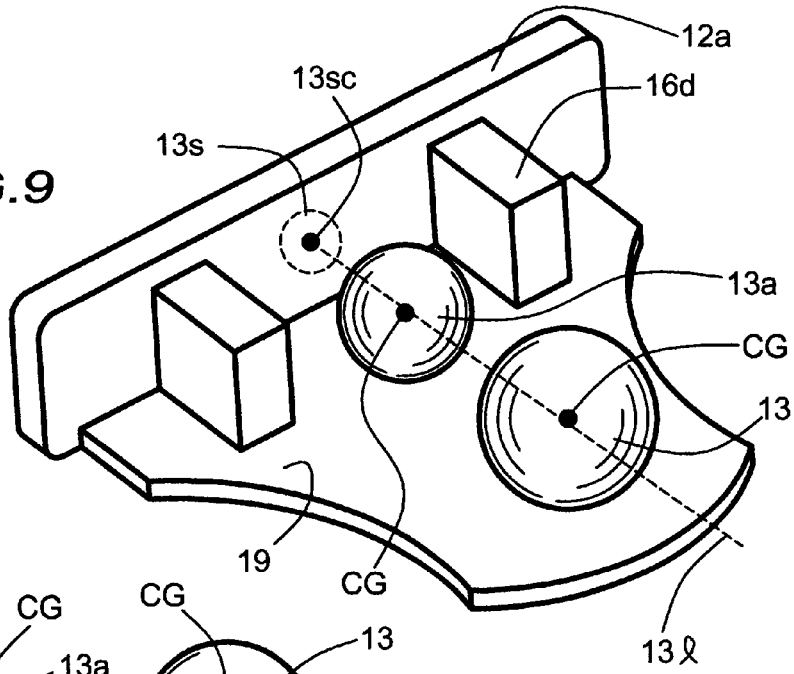

FIG. 9, is a top view of FIG. 8, with its top removed to illustrate the bottom plate, 19, with assembled components, 12*a*, the blade, 16*d*, two weights, 13 and 13*a* two spherical weights, mounted in line with the central line, 1, which extends from the center, 13*sc*, from the center of the sweet spot, 13*s*.

Figure 10:
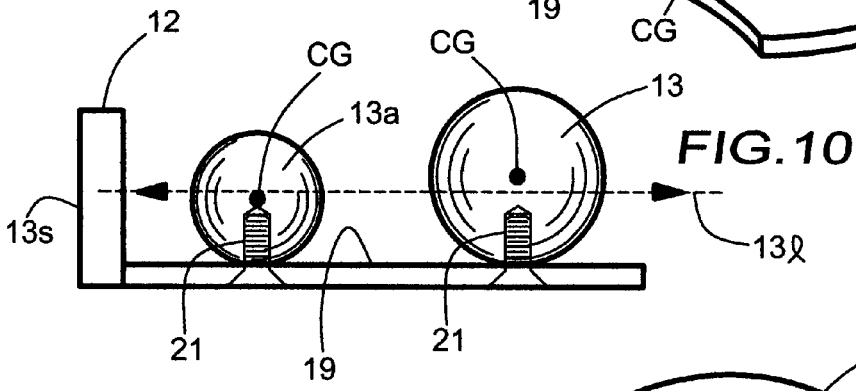

FIG. 10, is a side view of FIG. 9.

Figure 11:
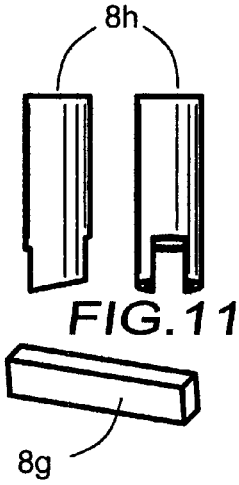

FIG. 11, illustrates the components, 8*h* and 8*b* that are bonded together to form the hosel sleeve 20*a*,which is positioned on top of the club head, FIG. 8.

FIG. 12, is a putter with a spherical weight at the toe and the heel, items 13, of the blade 12.

FIG. 13, is an "iron type" club head with a sphere, 13H, mounted on its back surface, substantially, at the sweet spot.

FIG. 13*h*, is a schematic of a sphere 13*h*, with a mounting screw 13*k*, for mounting the spherical weight, 13*h*, to the back of the club head.

FIG. 14, is an end view of the iron club head, FIG. 13.

FIGURE

FIG. 15, is a front view of the hosel in herein invention, 20, with flange 21.

FIG. 15*a*, is a back view of FIG. 15.

FIG. 15*b*, is a side view of FIG. 15

FIG. 16, is a "driver type club head" which is made hollow, 13*s*, a dotted circle represents it sweet spot.

FIG. 16*a*, is a general cut side view of club head, FIG. 16, wherein line, 13 *l*, is the first said "central line", extending rearward from the sweet spot, 13*s*. Spherical weight 13 is shown mounted to the bottom plate with a screw and wherein the center of the sphere is in line with the central line, 13 *l*, but below said line.

FIG. 16*c*, is a cut top view of club head FIG. 16, showing the center, the center of gravity of the spherical weight, in line with the central line, 13 *l*. CG indicates the center of gravity of the club head.

FIG. 16*b*, shows the spherical weight, 13 positioned at one side of the central line 13 *l*, but on a line issuing from the center of the sweet spot.

FIG. 16*d*, is like FIG. 16*b*, but the spherical weight is on the opposite side of line 13 *l*.

FIG. 17, is a schematic of an alignment of the spherical weight 13, in relation to a central line, 13 *l*, wherein the center of the sphere is in line with said central line, 13 *l*, wherein line 13 *l*, extends rearward from the center of the sweet spot, 13*sc*, of the sweet spot 13*s*.

FIGURE

Figure 18:
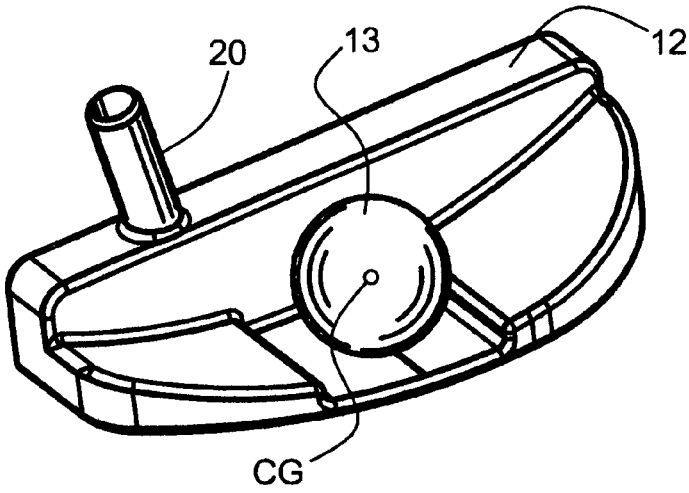

FIG. 18, is a conventional mallet type of putter club head, readily available in the market. This Figure illustrates how a spherical weight can be mounted on a conventional club head, wherein item 13, is a spherical weight. FIG. 18, is a rear, angular, view of said club head.

Figure 18A:
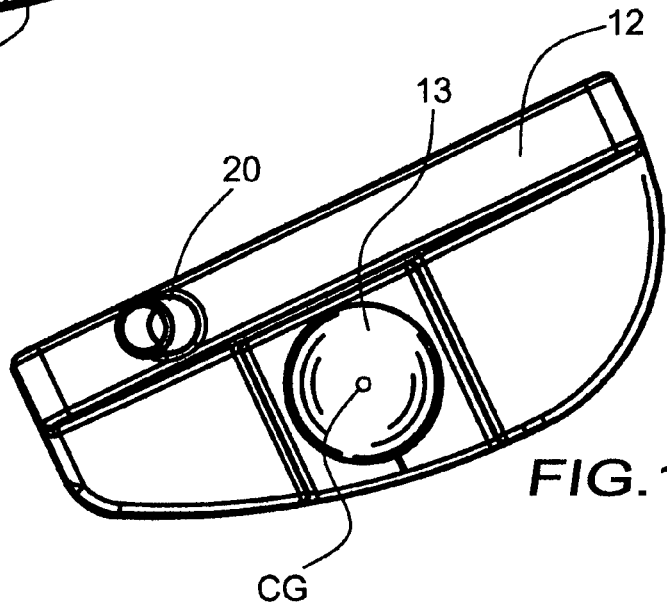

FIG. 18A, is a top view of FIG. 18, wherein the dot, CG, is the center of the said sphere.

Figure 19:
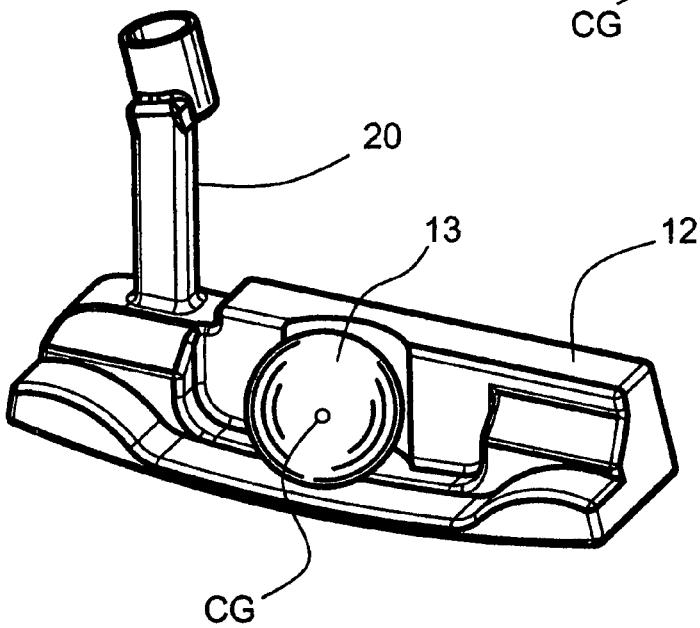

FIG. 19, is a rear, angular, top view, of a blade type putter club head, illustrating how Spherical weight 13, with its center, CG, is mounted at the rear of the club's blade. This putter club head is readily available as a conventional putter, in the market. FIGS. 18 and 19, are just a sample of how the spherical weight is mounted on conventional club heads.

Figure 20:
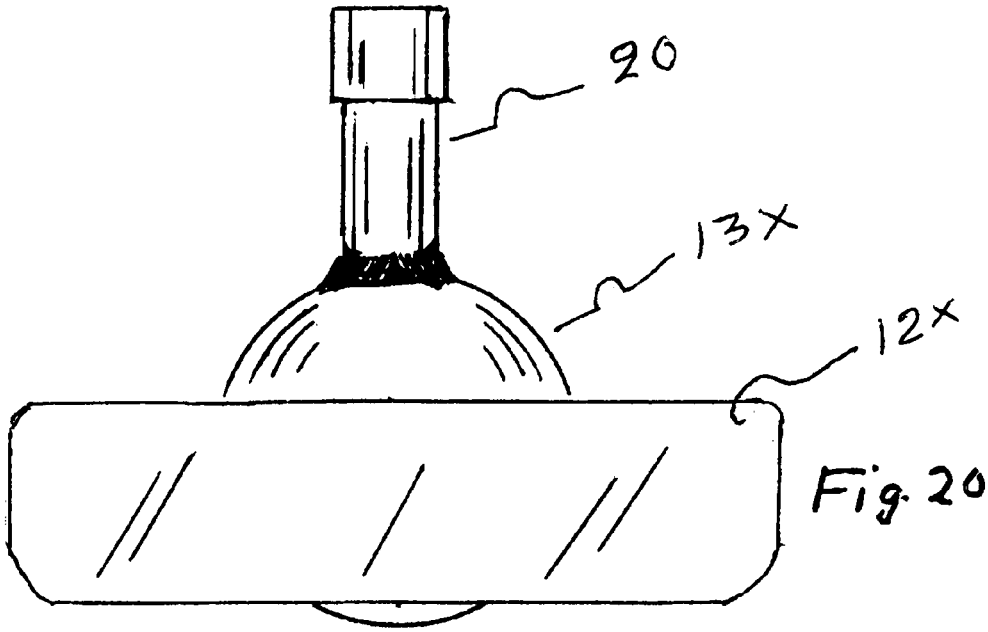

FIG. 20, is a putter type club head, wherein 20 is the hosel, 13*x* is the spherical weight, and 12*x* is the striking blade.

The figure is a front view.

Figure 21:
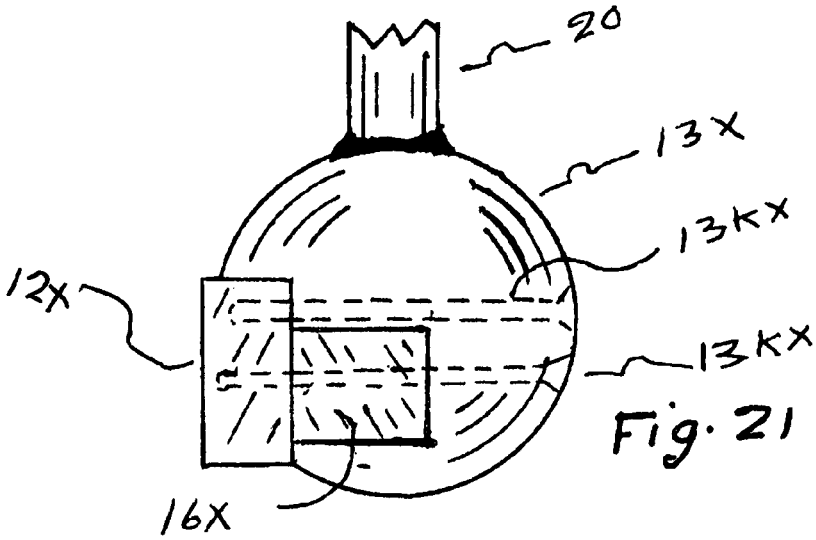

FIG. 21, is an end view of FIG. 20, illustrating, in addition to FIG. 20, the weight 16*x* and the two screws 13*kx*, for the attachment of the spherical weight to the blade.

Figure 22:
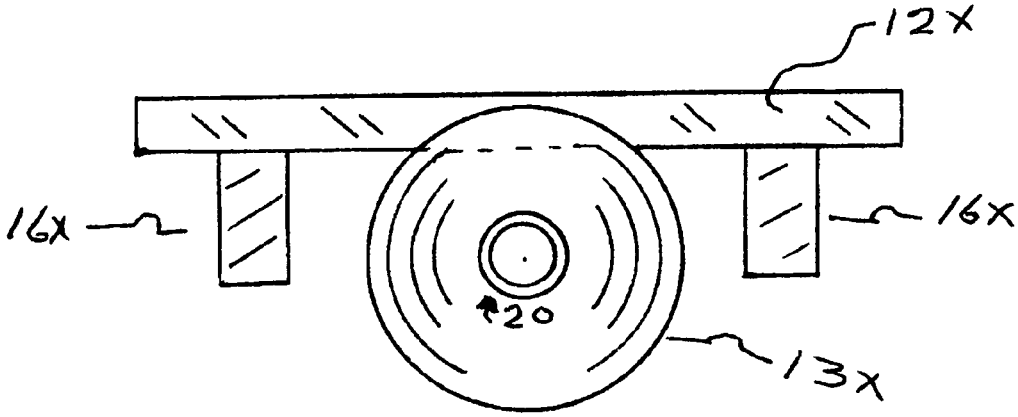

FIG. 22 is the top view of FIG. 20, illustrating the two weights, on each side of the spherical weight 13*x*.

BRIEF DESCRIPTION OF THE INVENTION

A metal sphere is used as an added component to golf club heads for the purpose of applying the many properties of a metal sphere to create an "inline momentum" in the golf club head during the golf club swing. This invention is entirely different in the application of a metallic sphere in golf club heads, utilizing not only the weight of the sphere, but also other properties not commonly known, and wherein the club head body is designed to coordinate with the momentum of the sphere. Wherein the spheres are made of steel, brass, lead, tungsten and other heavy metals.

One of the scientific properties of the metal sphere used in this invention, is that the sphere is in equilibrium at all times and in all manner of motion. ("A homogeneously constituted sphere, is in equilibrium at all times, static or in motion." Page 37, COLLEGE PHYSICS, A. L. Kimbal, Henry Molt and company.)

("A homogeneously constituted sphere functions as though all its mass is contained at its center, at a single-point." Pages 13 and 82, MODERN PHYSICS, Weld and Palmer, Maple Press.)

These properties of a metal sphere weight, as utilized in this invention, creates a golf club with unique advantages in the performance of the golf swing. The spherical weight with said above properties, when installed with herein specifications, develops a unique "in line momentum" which is an "in line force" and which assists in maintaining the line of golf swing in a defined path, driving the club head in a smooth, easy flowing motion during the swing of the golf club. Such an advantageous force, results in a managed swing with improved performance and accuracy.

When the club head is put into motion, the momentum of the sphere begins to exert its independent force in the golf swing. With the stated properties of the sphere, being in constant equilibrium, and its weight being at one point, at its center, combined with the spherical weight's inertia, the spherical weight dominates the swing with the created "in line momentum", resulting in an easier performed and improved golf swing.

The golf club heads, in herein invention, are constructed utilizing a metal sphere weight, wherein, a metal sphere weight is used in combination with the club head. Wherein, said golf club head comprises a predetermined "sweet spot" in its striking area, and wherein, the metal sphere weight is attached to said club head body precisely according to the following specifications:

The spherical weight is positioned and attached, to the club head, in line with the club head's "central line" which extends, substantially, from the center of the club head's "sweet spot", rearward through the club head.

Wherein, "the central line", extends rearward and, substantially, intersecting the vertical line through the center of gravity of the club head.

Wherein, the metal sphere weight is positioned and attached to the club head, wherein, the sphere's center point of gravity. is, substantially, in line with the "central line".

Wherein, the metal sphere weight is attached to the club head, being distanced from surrounding material, except at an attachment point."

Wherein, the sphere comprises a solid metallic mass.

Referring now more particularly to the drawings illustrating the applications of the metal sphere weight as an integral component of club heads.

FIG. 1, illustrates the embodiment of the spherical weight, 13, wherein, the metal sphere weight is mounted in line directly with the sweet spot on the back surface of the blade, 12, by means of a screw through the sphere and a threaded hole on the blade. Said screw and the spherical weight are shown in FIG. 13*h*. The "rectangular" weights, in this club head, extend evenly with the top of the rear surface blade, 12. Items 15 are the "rectangular" weights with top rear corners rounded. Item 14, is a plate extending rearward from the bottom edge of the blade, 12, wherein, this plate, strategically positioned, lowers the center of gravity of the club head to improve the functioning of the club head at impacting the golf ball. Item 20, is the hosel for the attachment of the shaft to the golf club head. FIG. 1*a*, illustrates the mounting of a metal sphere weight to the bottom plate.

FIG. 2, is similar to FIG. 1, except that the weights 16, are positioned below the top of the blade 12, and further, the spherical weight 13, is screwed into plate 14 by screw 21, FIG. 10. Item 20 is the hosel.

FIG. 3, is similar to FIG. 2, except that the spherical weight 13, is larger and screwed into plate 17 as shown in FIG. 10, with screw 21, and wherein the plate is semi-circular in shape and extends further out than plate 14, in previous figures. Items 16 are weights and item 20 is a hosel.

FIGS. 5, 9, 10 and 17, are schematic drawings illustrating herein specifications for the precise positioning of the spherical weights, which in part states that, "the metal sphere weight is positioned, with its center of gravity in line with said 'central line', of the club head." Line 13-1(L), FIG. 5, is an imaginary line from the center, 13*sc*, of sweet spot 13*s*, extended rearward from back surface of blade 12, wherein the spherical weight, 13*x*, is positioned with its center of gravity, in line with the line, 13-1. The metal sphere weights herein invention, are all positioned with these specifications.

FIG. 5, is a blade type of putter club head, wherein Items, 12 is the blade, in the perspective, rear view of the club head, 16, is a weight to further stabilize the club head when in motion, 14, is a plate to lower the center of gravity of the club head and is positioned at the bottom of the blade 12, between the weights 16, 16; 20 is the hosel for the attachment of the club shaft.

FIGS. 3 and 4, illustrate mounted spherical weights according to FIG. 5. FIG. 3, has a single spherical weight, 13, mounted by its center of gravity, CG, on a rounded bottom, 17, plate. FIG. 4 illustrates two metal spheres, 13 and 13*a*, with their center of gravities, CG, mounted as stated for FIG. 5, on a bottom rounded plate 18. (FIGS. 3 and 4 are perspective rear views of putter type blade club heads.)

FIGS. 3 and 4, are rear view perspectives of blade type of herein putters. As stated above, the metal sphere generates an "in-line momentum and force" to maintain the club head in motion and in line. The spherical weights 13, as mounted on a bottom plate, lowers the center of gravity of the club head which results in an improved control of the putter at impact and a more accurate putt. The weights 16, stabilize the club head and reduce the rotation of the club which is called moment of inertia. The spherical weights are mounted by means screw through the bottom of the plate and threaded into hole in the spherical weight or they may be bonded by means of adhesive.

FIG. 4, is similar to FIG. 3, except the plate 18, extends further and embodies two metal spheres mounted with screws 19, FIG. 20. Item 13 is a spherical weight as well as Item 13*a*, wherein Item 13*a* is smaller than sphere 13. Items 13*c* represent the center point of spheres which are in line with the central line. Item 12 is the blade, Items 16 are weights and Item 20 is the hosel.

FIG. 5, is a schematic drawing indicating the extended central line 13-1, extending rearward from the center of the sweet spot, 13*s*, wherein the center, 13*c*, of a sphere 13*x*, is positioned in line with said rearwardly extended central line. Wherein Item 12 is the blade, Item 14 is a plate, Items 16 are weights and Item 20 is the hosel.

When a conventional blade type putter is put into motion, there is a lag of the far end of the blade, in the opposite direction of the motion, which creates a rotational force (torque, moment of inertia) about the axis of the shaft. This also occurs, to a certain extent, when direction of the swing is changed during the golf swing. Most conventional blade type putters, have a concentration of weight at the far end of the blade, toe.

In order to remedy this situation, this invention has two "flange type", rectangular weights, one at each end of the blade, FIGS. 1 to 6. Said weights, 16, FIG. 6, are designed with substantial weight in order to counteract the moment of inertia around the shaft, as illustrated with FIGS. 6*a* and 6*b*. These are top views of the FIG. 6.

Referring to FIGS. 6*a* and 6*b*, the circular arrows at the ends of the blade, 12, indicate which direction the rotation is as compared with the direction of the large straight arrows. The dots, 16*c*, indicate the center of gravity of the weight 16, while the circular arrow on the side of weight 16, indicate the opposing circular force generated by these weights to counteract the indicated torque, rotational force, of the blade.

Thus the two designed rectangular weights, 16, positioned on the back surface of the blade, assist further in stabilizing the club head during the golf swing, resulting in an improved golf swing with accuracy.

FIG. 7, is the schematic drawing of the front of a putter club head. The circle, 13*s*, represents the "sweet spot" while the dot at the center indicates the most desired location on the club face, to impact the golf ball. The dotted area, indicates where impacts may occur in striking at the golf ball.

FIG. 8, illustrates a closed type of mallet putter golf club, while FIGS. 9, 10 and 11, indicate the components of the club head. FIG. 9, is a top view of the bottom and the inside of the club head with the top removed. In these figures, 12*a* is the blade, 16*d* is a rectangular weight positioned on each end of the blade. Item 19, is the bottom plate, while 13 and 13a, indicate two spherical weights, in line with their centers, in line with the central line 13-1, extending rearward from the center of the sweet spot 13*s*. FIG. 10, is a side view of FIG. 9, illustrating the two spheres, 13 and 13*a*, in line with said central line, 13-1, wherein sphere 13*a*, with a shorter radius, has its center just above the line because of its longer radius. FIG. 11, Items 8*b* and 8*h*, are components which are bonded and mounted on the top left corner of the club head, and serve as sleeve for mounting the golf club shaft. In FIG. 8, 12*b* is the blade, 19 is the bottom plate and 19*t* is the top plate including a surrounding spacer strip 19*s*. Dotted circles 13 and 13*a*, indicate the positions of the metal sphere within the club head. A weight of less than one ounce, is embodied at each end of the blade's back surface, to further stabilize the club head in motion.

FIG. 12, is an angular rear view of a club head, wherein, a spherical weight 13, is disposed at the toe and the heel of the blade 12. Item 20, is a hosel for the attachment of a golf club head shaft. The sphere at each end of the blade, will stabilize the club head and prevent twisting of the club head at impact.

FIG. 13, is a rear view of a blade type "iron", indicating a spherical weight, 13*h*, positioned in line with the "iron's" sweet spot. FIG. 13*h*, illustrates the extended screw from the spherical weight, 13*h*, utilized to attach the sphere to the back surface of the said iron. Said spherical weight 13*h*, may also be attached by means of an adhesive or with a combination of a screw and an adhesive. FIG. 14, is a top view of FIG. 13, illustrating the mounting of the spherical weight, 13*h*, into the back of the club head blade.

FIG. 15, illustrates different views of the hosel, used in this invention, Item 20, is the rear view of the hosel as seen mounted on the rear surface of the blade, in club head presented herein. Item 20*a* is the front view of the hosel, and Item 20*b*, is a side view of the hosel. The wide flange 21, at the bottom of said hosel, helps to minimize the twist of the club head at impact.

Wherein;

the height and width of the flange, substantially equals the height of the rear surface of the club head's blade, and its thickness, substantially equals one-half of the thickness of the said blade;

said flange, of the hosel, is attached to the back surface of the blade, between the rectangular weights and the center of the blade, that is, towards the left side of the blade; wherein said flange, during impact, applies the force over a larger area at the back of the blade, improving the stability and position of the club head at impacting the ball. This results in an improved putt and accuracy of the putt.

Referring back to FIGS. 13 and 14, the spherical weight, 13*h*, mounted in line with the "central line" rearward of the sweet spot, develops a smooth "in line momentum" for a better controlled swing with improved accuracy.

The club head is made of a combination of different materials, including steel, brass, tungsten, titanium, aluminum or injection molded, formed or machined from raw material. The club head may be made as a unit or assembled from individually made components by means of fasteners or adhesives.

FIGS. 16 through 16*d*, are "driver club heads" and also represent, herein, similar club heads which all have "enclosed-bodies", such as fairway woods and "iron woods", wherein the positioning of a spherical weight is relatively the same in all. FIG. 16, is the top front view of a driver. The dotted circle 13*s*, is the club head's sweet spot. FIGS. 16*a*, to 16*d*, are schematic drawings. FIG. 16*a* illustrates the mounting of the metal sphere, 13, inside the club head, by means of a screw through the bottom plate of the club head, into the sphere.

FIG. 16*c*, illustrates the positioning of spherical weight, 13, with its center 13*c* on line 13-1, which is the "central line" extending rearward from the center of the sweet spot, 13*s*. This alignment is also illustrated in the schematic drawing, FIG. 17. In FIG. 16*d*, the spherical weight is positioned to the right of the central line, 13-1, in order to compensate and remedy a "slice" at impact. In FIG. 16*b*, the spherical weight is positioned to the left of the central line 13-1, in order to compensate and remedy a "hook" at impacting the ball. (In a sliced ball, the trajectory is to the right ad in a hooked ball, the trajectory is to the left of the intended straight forward trajectory.)

The spherical weight is adapted to "existing conventional club heads." The following Figures, illustrate such "adaptations." FIG. 13, is a perspective view of an iron club head. FIGS. 16 and 16*a*, illustrate the use of the spherical weight, in drivers, fairway woods, and other enclosed type of club heads. FIG. 18, is a perspective view, and FIG. 18A, is a top view, of a mallet type putter. FIG. 19, is perspective of a conventional blade putter illustrating the use of the sphere.

A spherical weight may be used with other inventions, without conflict, for a variety of purposes, which are entirely different than the specific application in herein invention.

The solid spherical weight in this invention, as a component of a golf club head, is employed primarily to develop a consistent force in its direction of motion, which in turn, creates an "in line momentum force", and which results in a precise golf swing that is attained naturally with ease.

This invention is distinguished and unique in its application of a metal sphere to a golf club head, in that the spherical weight is positioned and attached according to herein precise specifications.

Primarily, all conventional golf club heads, possess a front striking surface and a corresponding back surface located opposite to said front striking surface. Further, said striking surface includes an area at its center, commonly known as the "sweet spot." This is the balanced location, on said surface, to impact the golf ball with the total weight of the club head. These are all features of conventional golf club heads.

The method and application of the spherical weight for the development of "in line momentum force," is different and unique than other uses of spheres in golf club heads. The golf club head, of this invention, comprises defining specifications and so. structured. Wherein, the weight of the club head, the metal sphere, and the golf club shaft, are substantially, all in one line. This produces a superior functioning golf club in comparison to conventional golf club heads which are actually made like a small paddle with an upright handle at one end and difficult to use.

Further, the metal sphere is attached to the club head, in at least one point of attachment.

A different type of putter club head is illustrated in FIG. 20, wherein the spherical weight is large and several times as heavy as spherical weights used in other club heads of this invention, item 13*x*. Item 12*x* is a blade and item 20 is a hosel. FIG. 20 is a front view of this club head. FIG. 21, is an end view, illustrating how the spherical weight is notched for the attachment, by means of two screws, 13*kx*, to the blade 12*x*. FIG. 22, is a top view of the club head, further illustrating two weights, 16*x*, on each side of the spherical weight. This is a very heavy club head for those who prefer heavy putters.

What is claimed is:

1. A golf club head comprising:

a front striking surface with a sweet spot, toe end, and a heel end;

a rear surface having a toe end and a heel end;

a pair of rectangular weights each having a top rear corner rounded to a bottom surface, wherein one of the rectangular weights being attached to and extending rearward from the toe end of the rear surface and the remaining rectangular weight being attached to and extending rearward from the heel end of the rear surface, wherein the each rectangular weight is of the same height of the rear surface and the thickness of each rectangular weight is less than the height of the rear surface;

a bottom plate attached to and extending between bottom surfaces of the pair of rectangular weights and rearward of a bottom portion of the rear surface;

a first solid metal sphere having a threaded aperture attached to a top surface of the bottom plate rearward of the rear surface by receiving a threaded fastener and being aligned with the sweet spot of the first striking surface such that the center of gravity of the first metal sphere is aligned with center of gravity of the club head;

wherein the rear surface, the bottom plate, and the pair of rectangular weights form a recessed area extending in a rearward direction; and a hosel attached within the recessed area to the rear surface between the rectangular weight nearest the heel end and the central line passing through the sweet spot, wherein the hosel comprises a wide flange at a bottom end to directly attach the hosel to the rear surface and wherein the wide flange is the only part of the hosel attached to the rear surface.

2. The club head of claim 1, wherein a second solid metal sphere is attached to the bottom plate and in line with the first solid metal sphere.

* * * * *

UNITED STATES PATENT AND TRADEMARK OFFICE

CERTIFICATE OF CORRECTION

PATENT NO. : 7,625,298 B2
APPLICATION NO. : 11/891906
DATED : December 1, 2009
INVENTOR(S) : John Emmanuel Bennett It is certified that error appears in the above-identified patent and that said Letters Patent is hereby corrected as shown below:

Title page, Item (74) on the cover page should be

ATTY-AGENT-FIRM: Joseph E. Mueth, Law Corporation

Signed and Sealed this

Second Day of February, 2010

David J. Kappos

David J. Kappos
*Director of the United States Patent and Trademark Office*